US012070792B2

(12) United States Patent
Rougier et al.

(10) Patent No.: US 12,070,792 B2
(45) Date of Patent: Aug. 27, 2024

(54) FOUNDRY MOLD FOR THE FORMATION OF TURBINE BLADE CERAMIC CORES

(71) Applicant: SAFRAN, Paris (FR)

(72) Inventors: Luc Rougier, Moissy-Cramayel (FR); Mirna Bechelany, Moissy-Cramayel (FR); Virginie Jaquet, Moissy-Cramayel (FR); Ngadia Taha Niane, Moissy-Cramayel (FR)

(73) Assignee: SAFRAN, Paris (FR)

( * ) Notice: Subject to any disclaimer, the term of this patent is extended or adjusted under 35 U.S.C. 154(b) by 0 days.

(21) Appl. No.: 17/596,167

(22) PCT Filed: Jun. 3, 2020

(86) PCT No.: PCT/FR2020/050941
§ 371 (c)(1),
(2) Date: Dec. 3, 2021

(87) PCT Pub. No.: WO2020/245538
PCT Pub. Date: Dec. 10, 2020

(65) Prior Publication Data

US 2022/0219226 A1 Jul. 14, 2022

(30) Foreign Application Priority Data

Jun. 6, 2019 (FR) ..... 1906003

(51) Int. Cl.
*B22C 9/06* (2006.01)
*B22C 9/10* (2006.01)
(Continued)

(52) U.S. Cl.
CPC ..... *B22C 9/06* (2013.01); *B22C 9/10* (2013.01); *B22C 9/22* (2013.01); *B22C 13/12* (2013.01)

(58) Field of Classification Search
CPC .. B22C 9/06; B22C 9/10; B22C 9/108; B22C 9/22; B22C 13/12
(Continued)

(56) References Cited

U.S. PATENT DOCUMENTS 3,160,931 A * 12/1964 Leach ..... B22C 9/106 264/28
4,321,010 A * 3/1982 Wilkinson et al. ..... F01D 5/189 416/96 A
(Continued)

FOREIGN PATENT DOCUMENTS

EP 1854569 A1 11/2007
FR 3022811 A1 1/2016
FR 3037830 A1 12/2016

OTHER PUBLICATIONS

French Search Report issued in French Application FR1906003 issued on Mar. 13, 2020 (6 pages).
(Continued)

*Primary Examiner* — Kevin P Kerns
(74) *Attorney, Agent, or Firm* — Bookoff McAndrews, PLLC

(57) ABSTRACT

A mold for producing a ceramic core by injecting a ceramic composition, the mold having a body in which a casting core cavity is formed, the cavity having a primary cavity and a secondary cavity connected by a plurality of segments, the mold being characterized in that it includes a primary arm configured in such a way as to allow an injection of ceramic composition into the primary cavity, and a secondary arm configured in such a way as to allow an injection of ceramic composition into the secondary cavity, and in that the ratio of the volume of the primary cavity to the volume of the secondary cavity is equal, plus or minus 15%, to the ratio of the volume of the primary arm to the volume of the secondary arm.

9 Claims, 3 Drawing Sheets

(51) Int. Cl.
*B22C 9/22* (2006.01)
*B22C 13/12* (2006.01)

(58) Field of Classification Search
USPC ..... 164/23, 24, 27, 28, 47, 159, 228, 369
See application file for complete search history.

(56) References Cited

U.S. PATENT DOCUMENTS

| | | | | |
|---|---|---|---|---|
| 2001/0024000 | A1* | 9/2001 | Lee et al. | B28B 7/0029 264/401 |
| 2007/0261811 | A1* | 11/2007 | Guerche et al. | B22C 9/103 164/369 |
| 2011/0132562 | A1* | 6/2011 | Merrill et al. | B22C 9/02 164/28 |
| 2018/0318913 | A1* | 11/2018 | Vollebregt et al. | F01D 5/20 |

OTHER PUBLICATIONS

International Search Report issued in International Application PCT/FR2020/050941 on Sep. 24, 2020 (2 pages).

* cited by examiner

[Fig. 1]
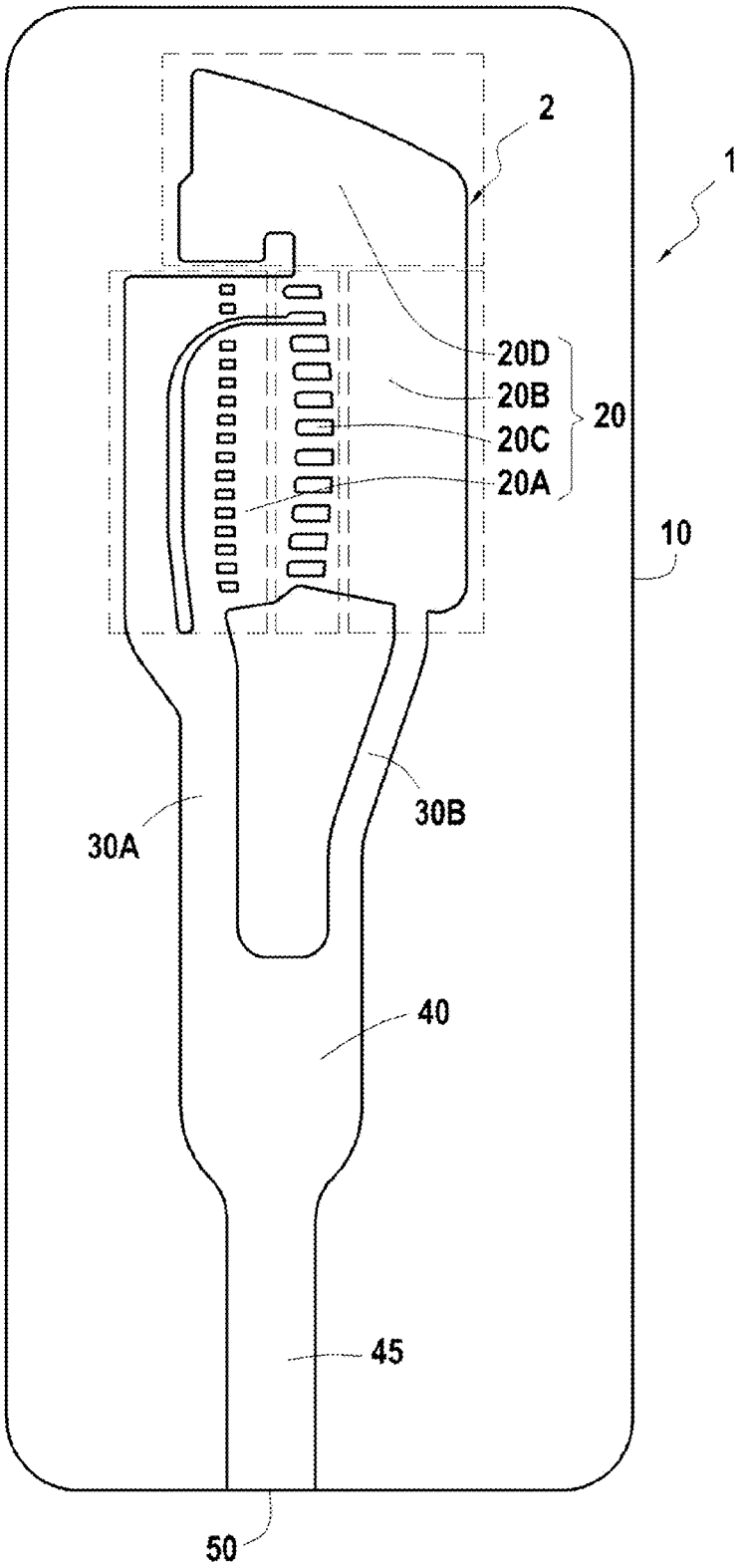

[Fig. 2]
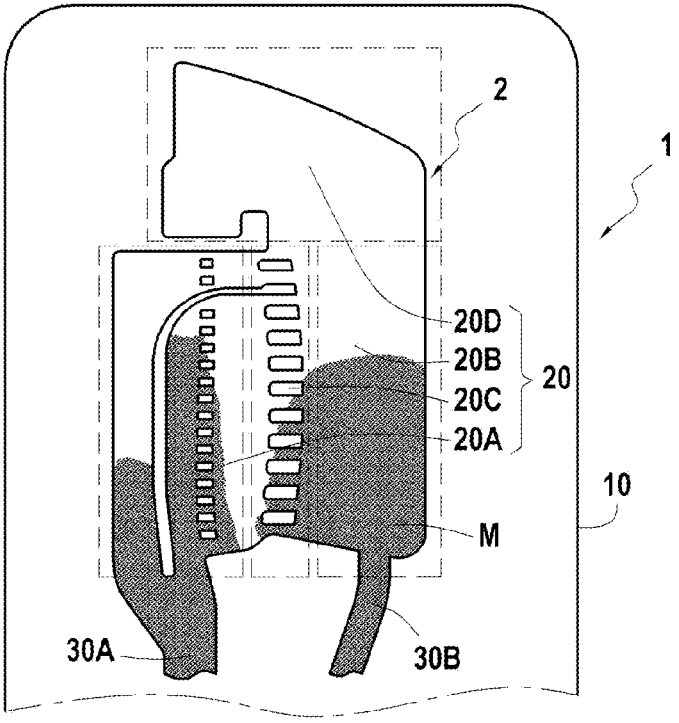
[Fig. 3]
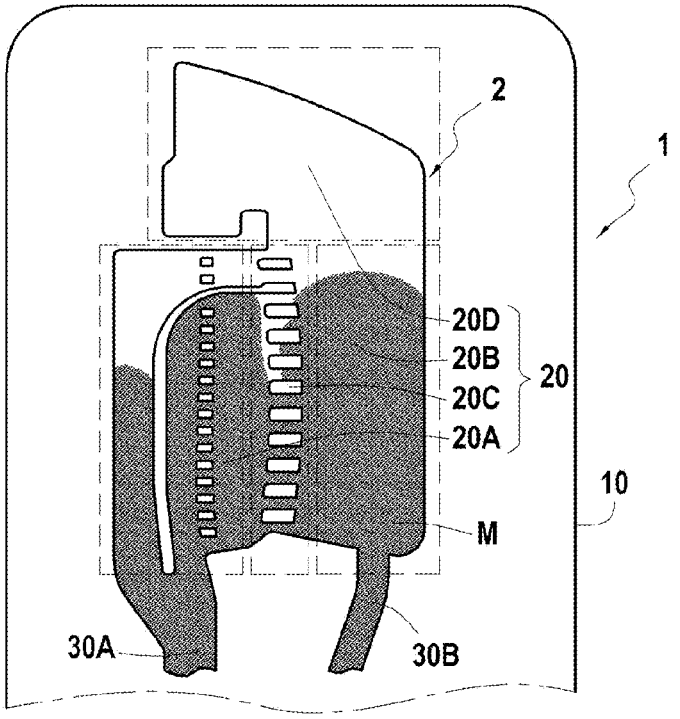

[Fig. 4]
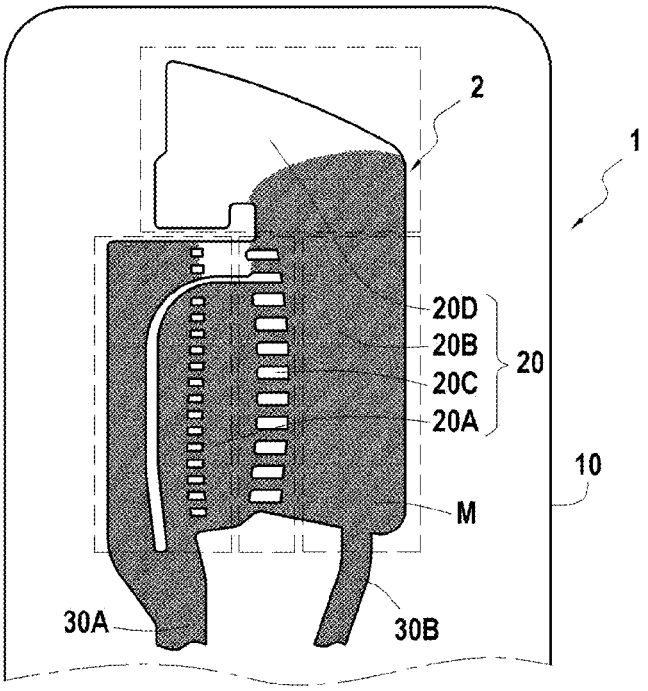

FOUNDRY MOLD FOR THE FORMATION OF TURBINE BLADE CERAMIC CORES

CROSS-REFERENCE TO RELATED APPLICATIONS

This patent application is the U.S. National Stage entry under 35 U.S.C. § 371 of International Patent Application No. PCT/FR2020/050941, filed on Jun. 3, 2020, which claims the benefit of priority to French Patent Application No. 1906003, filed on Jun. 6, 2019.

TECHNICAL FIELD

This summary relates to the field of turbomachines, and specifically relates to techniques for filling casting core molds for the production of cores for the purpose of producing turbomachine components.

PRIOR ART

The production of ceramic cores for the formation of turbomachine components, and more specifically for the formation of high-pressure turbine blades and high-pressure nozzle guide vanes of turbomachines poses a problem, particularly in relation to the specific geometry of such parts.

Ceramic cores are commonly produced by injection at medium or high pressure. A paste comprising a ceramic filler incorporated into a polymer binding agent is injected into a mold, thus making it possible to produce a raw body. After unmolding, the latter is then baked, which makes it possible to perform steps of debinding and sintering, respectively consisting in the elimination of the binding agent and the consolidation of the core. After these steps, the wax forming the model of the metallic part is injected around the core, the latter thus making it possible to delineate the inner cavity of the part.

The most recent core geometries comprise trailing edges including narrow and very fine teeth, for example up to 0.4 mm. On this type of geometry, cracks leading to the rupture of the cores have been observed virtually systematically, particularly after the baking of the core. They are often located in the teeth of the trailing edge, or in immediate proximity to the latter. It has been supposed that one of the phenomena contributing to these cracks/ruptures is the separation of the phases (binding agent and ceramic) when the paste is injected during the filling of the cavity under pressure. Interrupted injections have shown the formation of jetting in these teeth, which can prove detrimental to the quality of the front joints and to the homogeneity of the spatial distribution of binding agent/ceramic, once that material has traversed the teeth. It has also been assumed that this is linked either to the local geometry, which is characterized by passages in which the exchange surface with the mold in relation to the volume increases quickly, which causes a quick cooling of the paste, and therefore, potentially, the formation of fragile joints, and also by a shape that may locally promote convergent flows, the latter then increasing the risk of a poorly controlled increase in the flow speed of the paste. Moreover, local cooling, potentially quick, can be attenuated by increasing the speed of passage of the paste, but this then accentuates the segregation problem.

SUMMARY OF THE INVENTION

This summary thus aims to at least partly respond to the problems mentioned previously.

This summary thus relates to a mold for producing a ceramic core by injecting a ceramic composition, the mold comprising a body in which a casting core cavity is formed, said cavity comprising a primary cavity and a secondary cavity connected by a plurality of segments allowing the passing of fluid between the primary cavity and the secondary cavity, the primary cavity defining recesses of a turbomachine blade, said mold being characterized in that it comprises a primary arm configured in such a way as to allow an injection of ceramic composition into the primary cavity, and a secondary arm configured in such a way as to allow an injection of ceramic composition into the secondary cavity, and in that the ratio of the volume of the primary cavity to the volume of the secondary cavity is equal, plus or minus 15%, to the ratio of the volume of the primary arm to the volume of the secondary arm.

According to an example, the ratio of the contact surface of the primary arm with the body of the mold with respect to the volume of the primary arm is equal, plus or minus 20%, to the ratio of the contact surface of the secondary arm with the body of the mold with respect to the volume of the secondary arm.

According to an example, the primary arm and the secondary arm are connected to a common injection orifice of the mold.

The primary arm and the secondary arm are then typically connected to a feed cavity, the feed cavity being connected to an injection orifice of the mold.

According to an example, the segments comprise a plurality of segments each having a section having a dimension less than or equal to 1 $mm^2$.

According to an example, the primary arm and the secondary arm are embodied in a joint plane of the mold.

According to an example, the primary arm and the secondary arm each have a portion of reduced section at the level of their connection with the primary cavity and the secondary cavity, respectively.

This summary also relates to a method for producing a ceramic casting insert for producing a turbine blade, wherein

- a mold is supplied as previously defined,
- a ceramic composition is injected into the mold in such a way as to fill the primary cavity and the secondary cavity via the primary arm and the secondary arm, respectively.

According to an example, a subsequent step is performed of finishing the ceramic insert wherein the ceramic material corresponding to the secondary arm (or to the volume of the secondary arm) is removed.

This summary also relates to a ceramic core comprising

- a primary body and a secondary body connected by a plurality of teeth,
- a tertiary body extending from a proximal end of the secondary body,
- a primary branch extending from the primary volume,
- a secondary arm extending from a distal end of the secondary body, opposite the proximal end,
- a tertiary branch, connected to the primary branch and to the secondary branch, and
- a chimney, extending in the extension of the tertiary branch, in which the ratio of the volume of the primary body to the volume of the secondary body is equal to the nearest 15% to the ratio of the volume of the primary branch to the volume of the secondary branch.

BRIEF DESCRIPTION OF THE DRAWINGS

The invention and its advantages will be better understood on reading the detailed description given below of different embodiments of the invention given by way of non-limiting example.

FIG. 1 shows an example of a casting core produced by means of a mold and a method according to an aspect of the invention.

FIG. 2 illustrates a step of filling the mold according to an aspect of the invention.

FIG. 3 illustrates a step of filling the mold according to an aspect of the invention.

FIG. 4 illustrates a step of filling the mold according to an aspect of the invention.

On all the figures, common elements bear identical numeral references.

DESCRIPTION OF THE EMBODIMENTS

The figures schematically represent a view of a mold 1, which is here represented along a section plane of the mold 1. The mold 1 may have a rectangular parallelepipedal shape, it being understood that such an embodiment is not limiting, and that the mold can have any suitable shape, particularly as a function of the geometry of the associated core.

The mold 1 comprises a body 10 having an inner recess 2 defining a cavity of a casting core. The figures represent this recess 2 via the corresponding casting core. This is because it would lack clarity to represent a casting mold, which is by nature closed. The figures thus represent the casting core associated with each mold 1, these cores being the complementary volumes to the inner recess 2 of the mold 1 under consideration. The mold 1 is an injection mold, typically a mold used to inject ceramic paste.

In the example represented in FIG. 1, the recess 2 forms an cavity 20 defining the geometry of a core. In the example illustrated in the figures, the cavity 20 comprises a primary volume 20A and a secondary volume 20B connected by a plurality of segments 20C ensuring the passage of fluid between the primary volume 20A and the secondary volume 20B.

The primary volume 20A typically defines the inner cavities for a turbine blade, while the secondary volume 20B typically makes it possible to define a volume internal to a bar formed with the turbine blade when the material is injected, the bar being a reservoir of material aiming to avoid misruns in the manner of a flyweight. The primary volume 20A may thus be qualified as the functional part of the core, while the secondary volume 20B corresponds to an accessory volume, which will be removed during a machining operation to produce a finished part.

The primary volume 20A typically comprises several sub-volumes which can be disjointed or connected by segments having a reduced section with respect to the sub-volumes in question.

The primary volume 20A and the secondary volume 20B have inner volumes which are substantially equal, typically plus or minus 15%.

The segments 20C are commonly denoted as the "teeth" of the core, and are part of the functional volume of the core. These segments 20C comprise a plurality of ducts connecting the primary volume 20A and the secondary volume 20B. These ducts each having small dimensions in relation to the primary volume 20A and to the secondary volume 20B. Each of the segments 20C thus typically has a section of less than 1 $mm^2$.

The secondary volume 20B is surmounted by a tertiary volume 20D in the extension of the secondary volume 20B, the limit between the secondary volume 20B and the tertiary volume 20D substantially corresponding to the upper limit of the last segment 20C (or tooth) of the core. The tertiary volume 20D generally corresponds to the parts of the core defining the squealer and the dome of a blade produced using the core.

In the example represented, the recess 2 makes it possible to define the geometry of a core typically produced from ceramic for the purpose of producing a mobile wheel or a nozzle guide vane of a high-pressure turbine of a turbomachine by loss wax casting method. Note that the geometry of the recess 2 is not limiting, and that this summary can be applied to different core geometries.

The body 10 of the mold 1 comprises a primary arm 30A and a secondary arm 30B, respectively opening into the primary volume 20A and in the secondary volume 20B.

In the illustrated example, the primary arm 30A and the secondary arm 30B are both connected to a feed cavity 40, which is connected to an injection orifice 50 via an injection duct 45, in such a way as to make it possible to fill the cavity of the mold 1 with material. Note that unlike the secondary arm 30B which fulfils only one function of the material feed cavity, the primary arm 30A here fulfils a function for feeding the cavity of the mold 1 with material and also forms a functional part of the ceramic insert thus produced by defining a cavity in the cooling system of a blade formed using the ceramic insert. Thus, the secondary arm 30B which is not a functional part of the core is removed after producing the ceramic insert and before positioning the ceramic insert in a wax injection mold, while the primary arm 30A is preserved.

The feed cavity 40 is an intermediate volume, connecting the primary arm 30A and the secondary arm 30B to the injection duct 45. The feed cavity 40 is configured in such a way as to distribute a suspension or a fluid which is injected via the injection duct between the primary arm 30A and the secondary arm 30B.

The injection duct 45 is connected to the injection orifice 50, the latter being suitable for being connected to a feed source of a suspension or a pressurized fluid.

The primary arm 30A is used to fill the primary volume 20A with material, for example a ceramic suspension.

The secondary arm 30B is used to fill the secondary volume 20B with material, for example a ceramic suspension, avoiding the latter from filling the cavity exclusively by traversing the teeth, and reducing the cooling of the injected material.

The primary arm 30A and the secondary arm 30B typically extend in a joint plane of the mold 1. The injection duct 45 and the feed cavity 40 also typically extend in a joint plane of the mold 1, which makes it possible to facilitate the opening of the mold 1 after the injection of material.

In order to ensure the proper filling of the cavity 20, the secondary arm 30B is advantageously dimensioned in such a way as to ensure the distribution of material between the primary volume 20A and the secondary volume 20B of the cavity 20. Specifically, since the primary arm 30A is a functional part of the core, it cannot be freely dimensioned.

Thus, considering that the primary volume 20A has a volume V1, the secondary volume has a volume V2, the primary arm 30A has a volume V3 and the secondary arm 30B has a volume V4, these volumes are typically dimensioned such that the ratio V1/V2 is equal to the ratio V3/V4, typically to the nearest 20%, or for example to the nearest 15%, or for example substantially to the nearest 15%, or for example to the nearest 10%, or for example to the nearest 5%.

In the case where the volumes V1 and V2 are equal or substantially equal, then the volumes V3 and V4 are typically equal or substantially equal.

Advantageously the secondary arm 30B is also dimensioned in such a way that the primary arm 30A and the secondary arm 30B have equal or substantially equal ratios between their contact surfaces with the body 10 of the mold 1 and their respective volumes.

More precisely, for the primary arm 30A and for the secondary arm 30B a contact surface, respectively S3 and S4, is defined corresponding to the peripheral surface of each of the feed cavities. This contact surface corresponds to the surface of the body 10 of the mold which will be in contact with the material injected into the primary arm 30A or secondary arm 30B.

Thus, the secondary arm 30B is typically dimensioned such that the ratios S3/V3 and S4/V4 are equal or substantially equal, or typically equal to the nearest 20%.

Specifically, this ratio determines in particular the heat exchanges occurring between the material injected into the mold 1 and the body 10 of the mold 1. Thus, preserving a similar or identical ratio S/V allows the injected material to reach the primary volume 20A and the secondary volume 20B of the cavity 20 in substantially identical states, which improves material joints within the cavity 20.

Should the primary arm 30A and the secondary arm 30B be revolution cylinders, the ratio S/V then depends solely on the radius of the revolution cylinder section, which makes it possible to simplify the dimensioning of the primary arm 30A and of the secondary arm 30B.

The primary arm 30A typically has a portion of reduced section at the level of its joint with the primary volume 20A. Similarly, the secondary arm 30B typically has a portion of reduced section at the level of its joint with the secondary volume 20B.

Thus forming a shrinkage of the secondary at its end makes it possible to concentrate the thermomechanical stresses in the latter, which can facilitate the separation of the secondary with respect to the injected part, and therefore the finishing of the core, while reducing the risks of damage to the functional part of the core. However, this shrinkage is typically not very pronounced in order to avoid the segregation and/or formation of jetting at the level of the joint between the secondary volume 20B and the secondary arm 30B.

Once the secondary arm 30B has been dimensioned, a test is typically performed of the mold thus dimensioned by digital simulation, particularly in order to check the correct balance of the volumes of the different areas during the filling of the mold before producing the mold.

FIGS. 2, 3 and 4 illustrate different steps of the filling of such a mold for producing a ceramic casting insert with the aim of producing a hollow turbine blade.

FIG. 2 represents the entry of the material into the primary volume 20A and into the secondary volume 20B of the cavity 20, which is thus filled along two separate fronts.

FIGS. 3 and 4 illustrate the joint between the two material fronts M, as the cavity 20 of the mold 1 is filled.

In these figures it can be seen that the different regions of lesser thickness, particularly the segments 20C and where applicable portions of lesser thickness within the primary volume 20A, are filled with material directly after the material penetrates the primary volume 20A or the secondary volume 20B. Such a configuration greatly reduces or cancels the risk of misruns and segregation and/or formation of jetting, particularly by avoiding material coming from the same arm having to pass through two restrictions of the mold 1.

In addition, it can be seen that the joint between the two material fronts is done quickly after the entry of the material into the primary volume 20A and into the secondary volume 20B, typically at the level of the segments 20C.

The joint is thus made while the material has a relatively high temperature which ensures good mixability and avoids or limits the formation of discontinuities or other defects due to rapid variations in viscosity within the material.

The core thus produced then comprises a primary body, a secondary body and a tertiary body respectively corresponding to the primary volume 20A, to the secondary volume 20B and to the tertiary volume 20D, the primary body and the secondary body being connected by teeth corresponding to the volume of the segments 20C. The primary arm and the secondary arm respectively define a primary branch and a secondary branch extending from the primary body and the secondary body respectively, the secondary branch extending from a distal end of the secondary body, opposite a proximal end of the secondary body from which the tertiary body extends. The primary branch and the secondary branch meet at the level of a tertiary branch corresponding to the volume defined by the feed cavity 40, and extending by a chimney corresponding to the volume of the injection duct 45.

Once the mold is filled and the ceramic insert formed, the part of the insert corresponding to the volume of the secondary arm 30B is removed, for example by machining.

The mold structure as proposed has several advantages over a conventional mold for the production of such a core which comprises only a single feed cavity.

As previously indicated, the proposed mold makes it possible to limit the risks of misruns as well as the formation of segregated areas and jetting in the part, and also the risks of incorrect joining of material. By limiting the formation of segregated areas, the proposed mold makes it possible to limit differential removal causing the deformation and rupture of the core. Moreover, the proposed mold makes it possible to limit residual stresses as well as the pressure observed within the injected material, which thus makes it possible to obtain a casting core with better properties, and which is therefore less liable to break during use, for the purpose of forming a turbine blade of a turbomachine. The reduction of the pressure during the injection in particular makes it possible to reduce wear of the mold 1. In the same way, the reduction of the shear rates makes it possible to reduce the risk of phase separation.

The use of such a structure of mold 1 has never been proposed for the production of ceramic cores for the purpose of producing turbine blades of a turbomachine.

Although this invention has been described with reference to specific exemplary embodiments, it is obvious that modifications and changes can be made to these examples without departing from the general scope of the invention as defined by the claims. In particular, individual features of the different illustrated/mentioned embodiments may be combined in additional embodiments. Consequently, the description and drawings must be considered in an illustrative sense rather than a restrictive one.

It is also obvious that all the features described with reference to a method are transposable, alone or in combination, to a device, and conversely, all the features described with reference to a device are transposable, alone or in combination, to a method.

The invention claimed is:

1. A mold for producing a ceramic core by injecting a ceramic composition, the mold comprising a body in which a casting core cavity is formed, said cavity comprising a primary cavity and a secondary cavity connected by a plurality of segments allowing a passing of fluid between the primary cavity and the secondary cavity, the primary cavity and the segments defining recesses of a turbomachine blade and the shape of the ceramic core to be produced, the secondary cavity defining a non-functional part being adapted to be removed from the ceramic core, wherein the primary cavity and the secondary cavity are sub-volumes of the mold, and the plurality of segments that connect the primary cavity and the secondary cavity have reduced sections with respect to the primary cavity and the secondary cavity, said mold being characterized in that it comprises a primary arm configured in such a way as to allow an injection of ceramic composition into the primary cavity, and a secondary arm configured in such a way as to allow an injection of ceramic composition into the secondary cavity, and in that the ratio of the volume of the primary cavity to the volume of the secondary cavity is equal, plus or minus 15%, to the ratio of the volume of the primary arm to the volume of the secondary arm.

2. The mold as claimed in claim 1, wherein the ratio of a contact surface of the primary arm with the body of the mold with respect to the volume of the primary arm is equal, plus or minus 20%, to the ratio of a contact surface of the secondary arm with the body of the mold with respect to the volume of the secondary arm.

3. The mold as claimed in claim 1, wherein the primary arm and the secondary arm are connected to a common injection orifice of the mold.

4. The mold as claimed in claim 3, wherein the primary arm and the secondary arm are connected to a feed cavity, the feed cavity being connected to an injection orifice of the mold.

5. The mold as claimed in claim 1, wherein the segments comprise a plurality of segments each having a section having a dimension less than or equal to 1 $mm^2$.

6. The mold as claimed in claim 1, wherein the primary arm and the secondary arm are embodied in a joint plane of the mold.

7. The mold as claimed in claim 1, wherein the primary arm and the secondary arm each have a portion of reduced section at a level of their connection with the primary cavity and the secondary cavity respectively.

8. A method for producing a ceramic casting insert for producing a turbine blade, wherein a mold as claimed in claim 1 is supplied, a ceramic composition is injected into the mold in such a way as to fill the primary cavity and the secondary cavity via the primary arm and the secondary arm respectively.

9. The method as claimed in claim 8, wherein a subsequent step is performed of finishing the ceramic casting insert wherein a ceramic material corresponding to the secondary arm is removed.

* * * * *